US009330635B1

(12) United States Patent
Erdmann

(10) Patent No.: US 9,330,635 B1
(45) Date of Patent: May 3, 2016

(54) STRAP FREE ERGONOMIC GUITAR WITH STABILIZING SOUND BOX REST POCKET AND OPTIONAL GRIPPING PAD

(71) Applicant: Charles Erdmann, Wantagh, NY (US)

(72) Inventor: Charles Erdmann, Wantagh, NY (US)

( * ) Notice: Subject to any disclaimer, the term of this patent is extended or adjusted under 35 U.S.C. 154(b) by 0 days.

(21) Appl. No.: 14/754,665

(22) Filed: Jun. 29, 2015

(51) Int. Cl.
*G10D 3/00* (2006.01)
*G10D 1/08* (2006.01)

(52) U.S. Cl.
CPC . *G10D 1/085* (2013.01); *G10D 1/08* (2013.01)

(58) Field of Classification Search
CPC ..... G10D 1/085; G10D 1/08
See application file for complete search history.

(56) References Cited

U.S. PATENT DOCUMENTS 4,966,062 A * 10/1990 Driggers ..... G10G 5/005 224/910
5,388,492 A * 2/1995 Olson ..... G10G 5/005 224/910
5,567,894 A * 10/1996 Shiomi ..... G10D 1/08 84/267
7,169,991 B2 * 1/2007 Ralbovsky ..... G10D 3/02 84/267
7,183,473 B2 * 2/2007 Untermyer ..... G10D 3/02 84/267
7,205,468 B1 * 4/2007 Johnson ..... G10G 5/005 84/327
7,449,624 B2 11/2008 Boute
8,901,403 B2 * 12/2014 Barnett ..... G10G 5/005 84/327
2004/0182221 A1 * 9/2004 Burrell ..... G10D 3/02 84/291
2007/0044633 A1 * 3/2007 Gregory ..... G10G 5/005 84/327

* cited by examiner

*Primary Examiner* — Robert W Horn

(57) ABSTRACT

The sound box of a guitar is modified to add a concave shaped pocket that can be placed at various locations along the sound box body in order to be used to rest against the thigh of the instrumentalist while in the sitting position. An optional rubber gripping pad can be attached to the sound box rest pocket to add additional gripping power if desired. The sound box rest pocket can be applied to both electric and acoustic guitars and eliminates the need to wear guitar straps when playing in the sitting position. The sound box rest pocket does not negatively affect the quality of the sound produced from the guitar.

7 Claims, 21 Drawing Sheets

STRAP FREE ERGONOMIC GUITAR WITH STABILIZING SOUND BOX REST POCKET AND OPTIONAL GRIPPING PAD

FIELD OF THE INVENTION

The present invention relates to guitars, and more particularly to a guitar that has a sound box that has been modified to allow for a more stable guitar position on the body while playing.

BACKGROUND OF THE INVENTION

Guitars are traditionally played in a variety of positions including standing and sitting positions. Traditionally straps have been used to help keep the guitar in a stable position on the body while playing. In the standing position, the use of guitar straps is indeed effective in keeping the guitar in a stable position on the body and is still the most frequently used method today. However, in the sitting position, the use of guitar straps is far less effective at keeping the guitar stable for several reasons. One reason is that in the sitting position a strapped guitar is being supported both from the neck and on the thigh of the instrumentalist. While playing the guitar in the sitting position many instrumentalists shift their body weight around which can sometimes cause the guitar to shift out of position. Since the sitting strapped guitar is supported from two independent areas of the body which can move independently during play, this can cause many points during play where the guitar may not be in the optimum playing location for the instrumentalist.

Yet another example of why the strapped guitar is not ideal in the sitting position is due to the irritation caused from the guitar strap at the surfaces where it is in contact with the neck of the instrumentalist. This irritation can come from different material properties of the guitar strap such as the amount of friction it has on human skin as well as possible adverse skin reactions with the strap fabric on some instrumentalist.

A third example is due to the design of the sound box of the guitar itself. Most guitar manufacturers still use traditional figure eight style shapes with either square edges or only slightly radiused corners. When these corners rest against the curved thigh of the instrumentalist, there is very little surface area to grip to the instrumentalist and frequently the instrumentalist compensates for concerns of the guitar slipping down the thigh by keeping their neck taught against the guitar strap. During extended periods of play this can cause a fair amount of discomfort to the instrumentalist, and over many years of play may even contribute to neck and upper back pain requiring regular chiropractic therapy.

Clearly, there is a need to improve the design of the sound box of the guitar itself to provide a better alternative to the old method of using guitar straps. It is the objective of the present invention to improve upon the design of the guitar sound box in order to allow the modern instrumentalist to play the guitar in all common forms of sitting positions without the use of guitar straps.

There have been a few limited attempts in the prior art to make ergonomic improvements to the guitar sound box. U.S. Pat. No. 7,169,991 Guitar issued to Ralbovsky in 2007 discloses a contoured concave pocket shape along the upper half of the backside of the guitar sound box to prevent discomfort and unwanted compression of the guitar against the breast of female instrumentalist while playing. Although Ralbovsky's invention would effectively address this problem with female instrumentalist, it certainly does not provide any extra stability to the guitar while playing in the sitting position and would be of no benefit to male instrumentalists.

U.S. Pat. No. 7,183,473 Ergonomic Stringed Instrument and Ergonomic Roundback Guitar issued to Untermyer et al in 2007 discloses a complex contoured curved three dimensional shape on the entire backside of the guitar sound box. Although Untermyer's invention does provide ergonomic advantages over the traditional guitar sound box for the instrumentalist, it does not offer any ability to increase stability while resting on the thigh and due to its smooth curvature may actually tend to slip on the thigh even more than the guitar sound box of prior art.

Finally, U.S. Pat. No. 7,449,624 Ergonomic Classical Guitar issued to Boute in 2008 discloses a sound box with two truncated pockets to help the instrumentalist during playing in both the classical and standard sitting positions. Although Boute's improvements do offer some degree of improvement over the guitars of prior art, the truncated portions are substantially 45 degree planar chamfered shapes and they do not contour around the convex curvature of the thigh of the instrumentalist. Furthermore, there is no mention of adding any means to increase gripping friction on the planar shapes in Boute's invention and therefore Boute's guitar would most likely still require additional supporting means such as the traditional guitar strap to prevent the guitar sound box from slipping down on the thigh during play.

Clearly, the ergonomic guitar inventions of prior art as evidenced by these examples do not provide a fully stabilized guitar while playing in the sitting positions and would all require the use of guitar straps to prevent slippage on the thigh during play. It is the object of the present invention to disclose several embodiments of a novel guitar sound box that has a contoured concave pocket shape to provide ergonomic improvements in various sitting positions as well as an optional capability to increase gripping power against the thigh by using an attached gripping pad.

BRIEF SUMMARY OF THE INVENTION

It is a primary object of the present invention to provide an ergonomic guitar with a contoured rest pocket available in various configurations that will allow the instrumentalist to play in the sitting position without the need for wearing a guitar strap.

It is yet another object of the present invention to provide an optional gripping pad that has a contoured shape to fit into the contoured rest pocket to provide additional gripping power to further increase stability while playing in any sitting position.

DETAILED DESCRIPTION OF THE INVENTION

Figure 1:
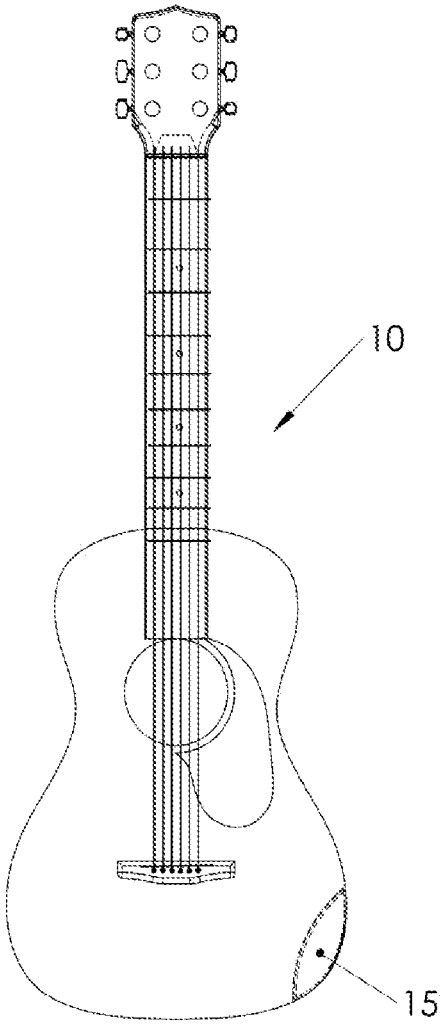
FIG. 1 is a front view of the ergonomic guitar with a sound box rest pocket located to provide better stability to the instrumentalist while playing the classic sitting position.
Figure 2:
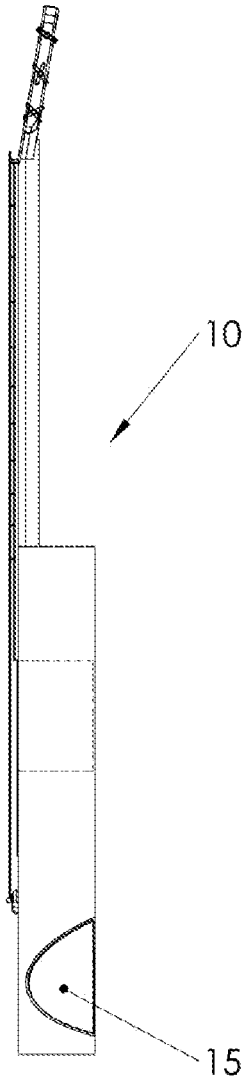
FIG. 2 is a side view of the ergonomic guitar with a sound box rest pocket located to provide better stability to the instrumentalist while playing the classic sitting position.

Referring now to the drawings and in particular FIGS. 1 through 5, an acoustic guitar is designated by reference number 10. In a primary embodiment, a concave shaped pocket 15 is located on the sound box at the location shown. In this first embodiment, the location of the pocket 15 as shown in FIG. 1 is intended for the instrumentalist to rest said pocket 15 against his thigh while playing in the classical sitting position. It should be noted that all of the drawings shown in this specification are drawn for right-handed guitar players. For left-handed players, the sound box rest pockets would be located on the opposite side as shown in these drawings. Referring next to FIG. 2, the full shape of the classical sound box rest pocket 15 is shown as looking at the guitar 10 on the right side.

Figure 3:
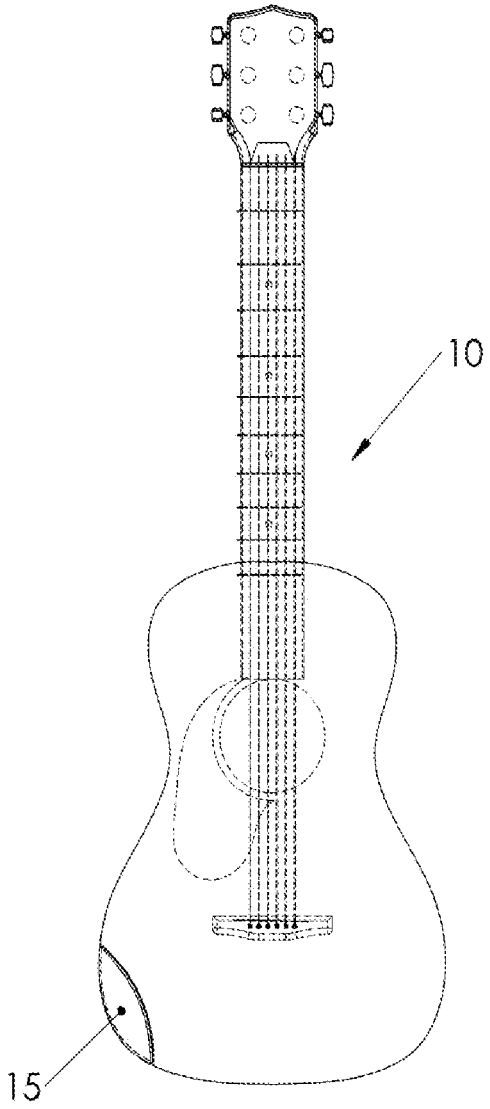
FIG. 3 is a back view of the ergonomic guitar with a sound box rest pocket located to provide better stability to the instrumentalist while playing the classic sitting position.
Figure 4:
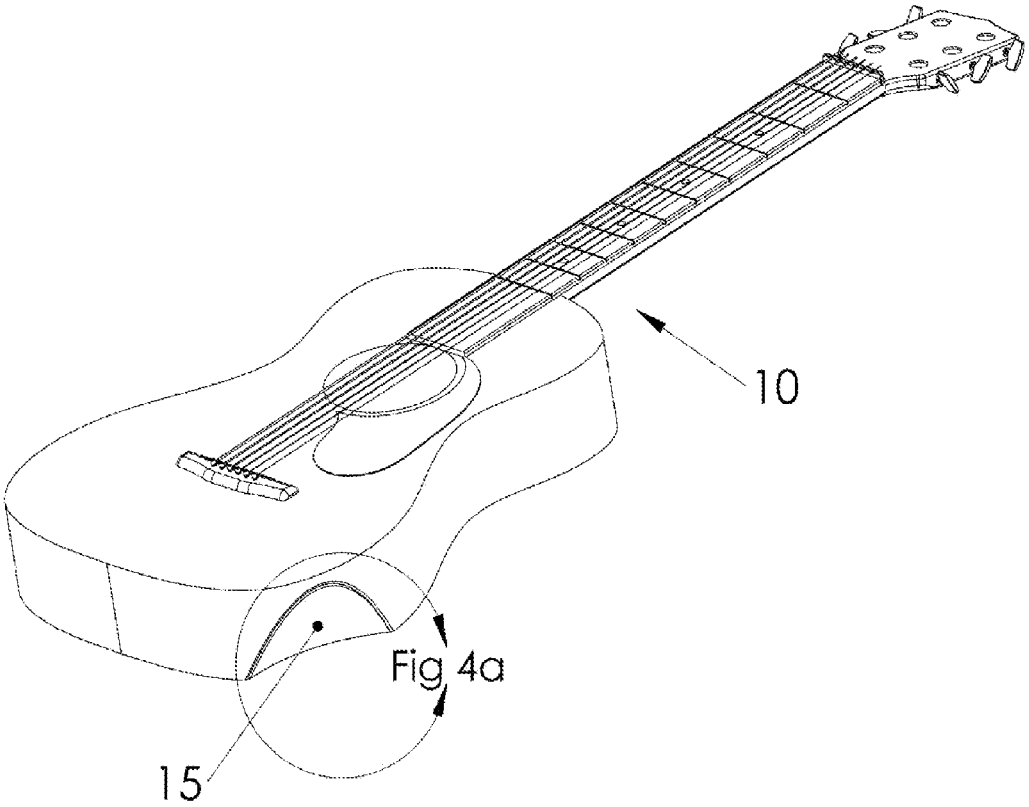
FIG. 4 is a perspective view of the ergonomic guitar with a sound box rest pocket located to provide better stability to the instrumentalist while playing the classic sitting position.
Figure 4A:
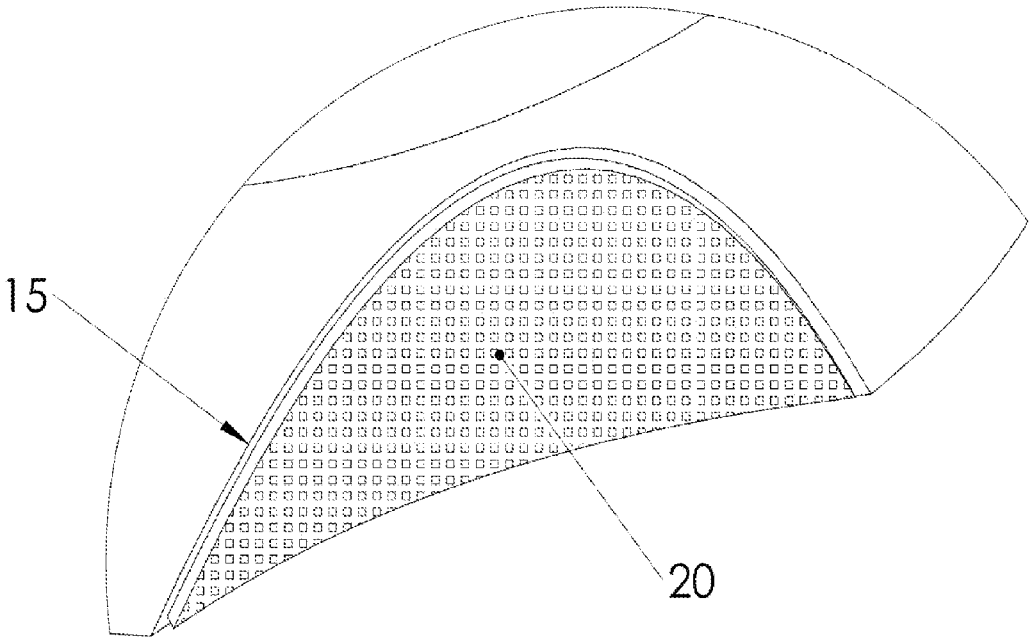
FIG. 4*a* is a detailed perspective view of the ergonomic guitar classical sound box rest pocket with an optional gripping pad.

It is intended that a variety of curved concave shapes are possible to create said classical rest pocket 15 such as parabolic or arcuate geometries. The top apex of the curve in the preferred embodiment is located below the front face of the sound box by approximately ¼ to ½ inch. Referring next to FIGS. 3 and 4, the classical sound box pocket 15 is shown in the back and perspective views so that the concave curvature shape can be seen. This concave shape of the pocket provides a contoured fit on the upper thigh of the instrumentalist and keeps the guitar in a stable position without the need for wearing guitar straps. An alternative embodiment of the classical rest pocket 15 is shown in FIG. 4*a* where a thin gripping pad 20 is shown attached to said rest pocket 15. In the preferred embodiment, the gripping pad is made of a resilient material such as neoprene rubber and may have a textured surface as shown in order to increase the gripping power of the pad. Various means are possible to attach the gripping pad to the sound box rest pocket such as pressure sensitive adhesives. The thickness of the gripping pad in the preferred embodiment may be between 1/32 and 3/16 of an inch. The gripping pad 20 would be cut such that it fits inside the perimeter of the sound box rest pocket as shown in FIG. 4*a*.

Figure 5:
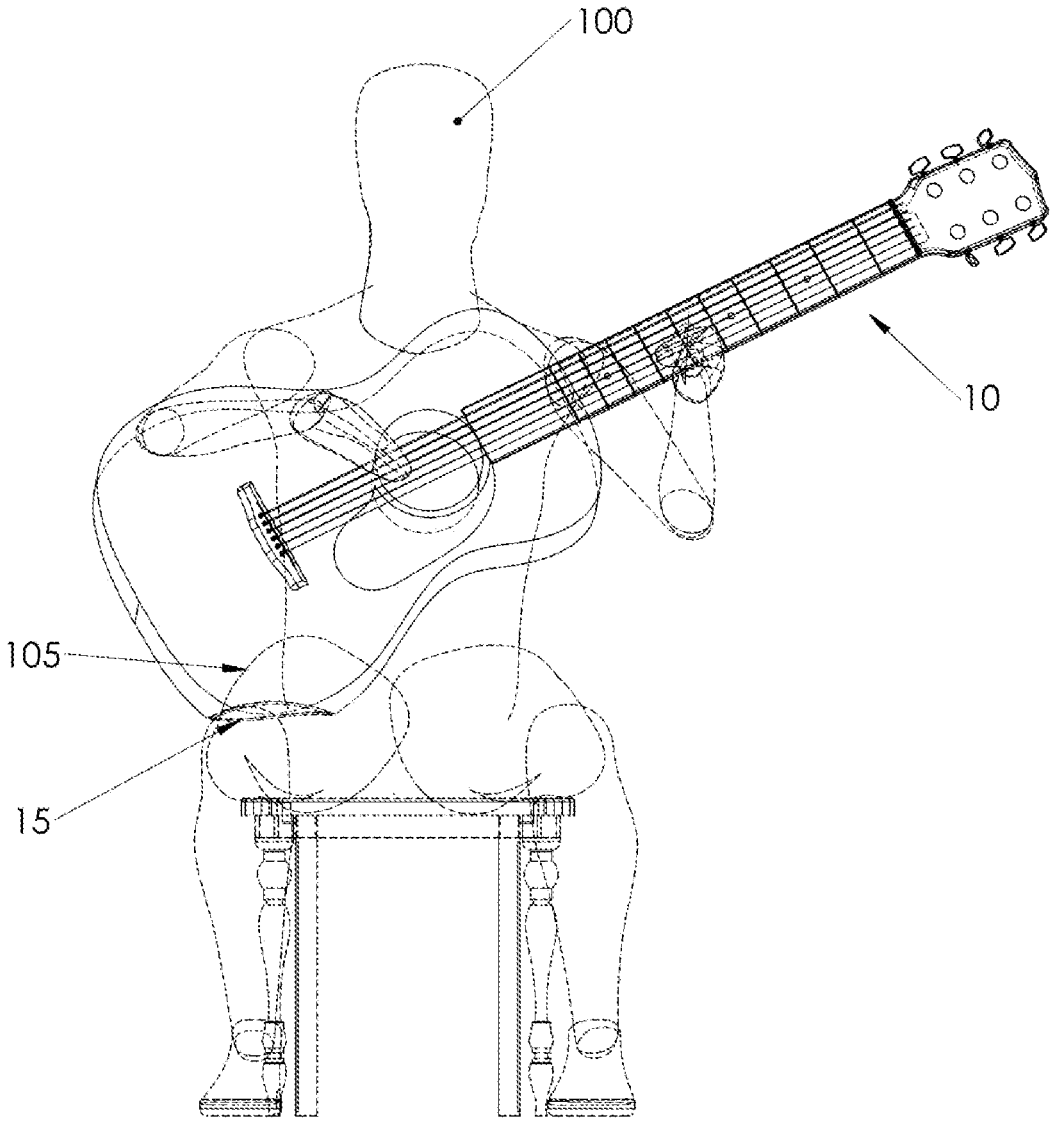
FIG. 5 is a view showing the use of the ergonomic guitar with a classical sound box rest pocket.

Referring now to FIG. 5, the intended use of the guitar with classical sound box rest pocket 15 is shown in the classical sitting position as represented by a right-handed instrumentalist 100. The concave shape of the rest pocket 15 fits over the upper right thigh 105 and creates a comfortable yet stable playing position.

Figure 6:
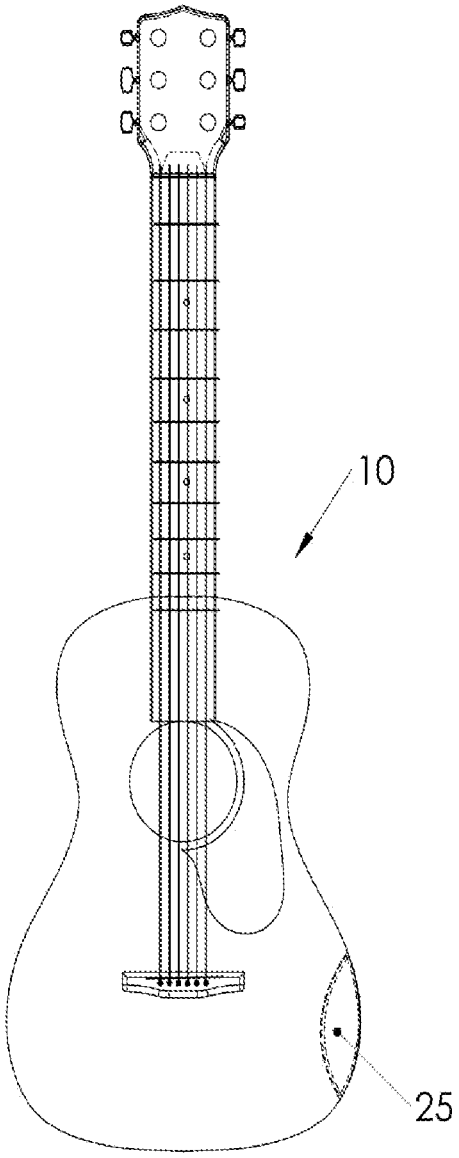
FIG. 6 is a front view of the ergonomic guitar with a sound box rest pocket located to provide better stability to the instrumentalist while playing the standard sitting position.
Figure 7:
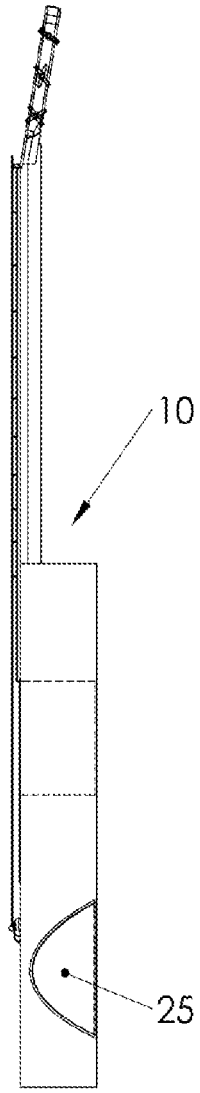
FIG. 7 is a side view of the ergonomic guitar with a sound box rest pocket located to provide better stability to the instrumentalist while playing the standard sitting position.

Referring next to FIGS. 6 through 10, an acoustic guitar is again designated by reference number 10. In a secondary embodiment, a concave shaped pocket 25 is located on the sound box at a position further up along the sound box as shown in FIG. 6. In this second embodiment, the location of the pocket 25 is intended for the instrumentalist to rest said pocket 25 against his thigh while playing in the standard sitting position. Referring next to FIG. 7, the full shape of the standard sound box rest pocket 25 is shown as looking at the guitar 10 on the right side.

Figure 8:
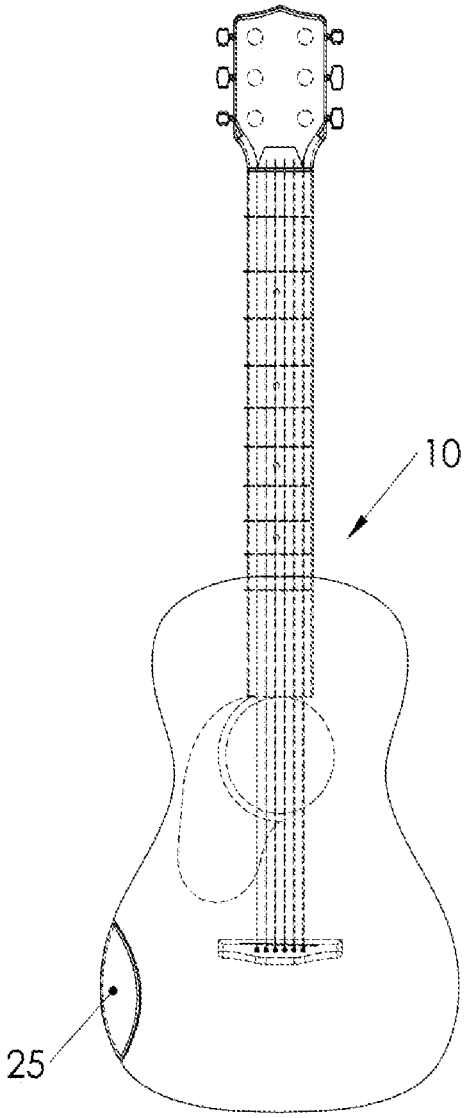
FIG. 8 is a back view of the ergonomic guitar with a sound box rest pocket located to provide better stability to the instrumentalist while playing the standard sitting position.
Figure 9:
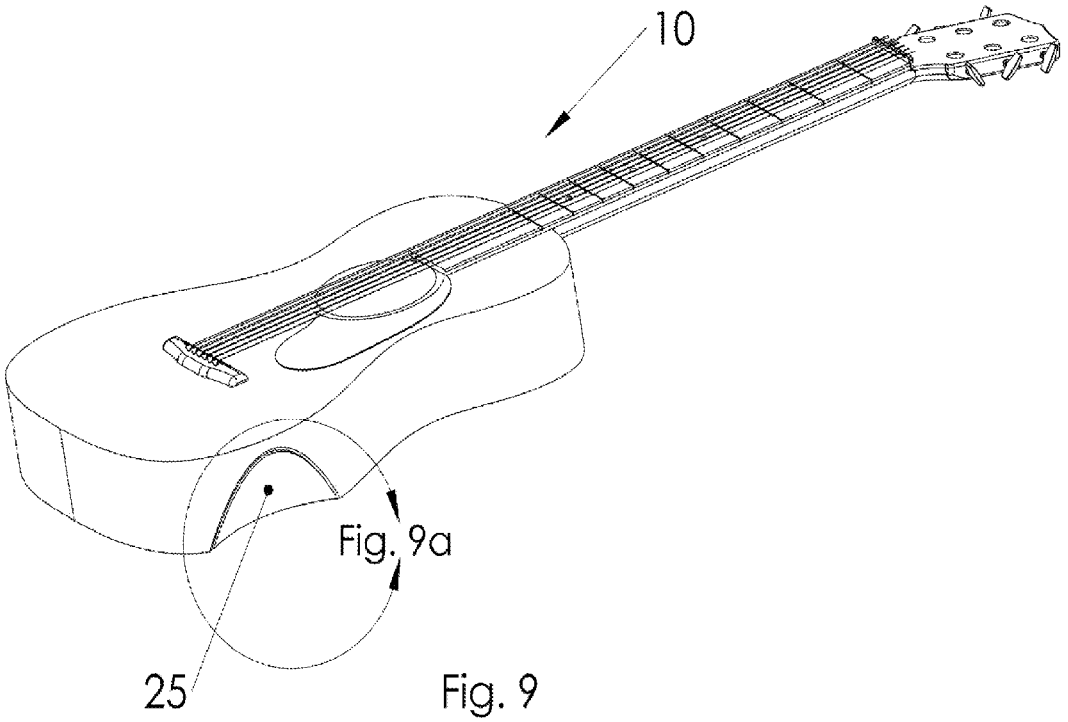
FIG. 9 is a perspective view of the ergonomic guitar with a sound box rest pocket located to provide better stability to the instrumentalist while playing the standard sitting position.
Figure 9A:
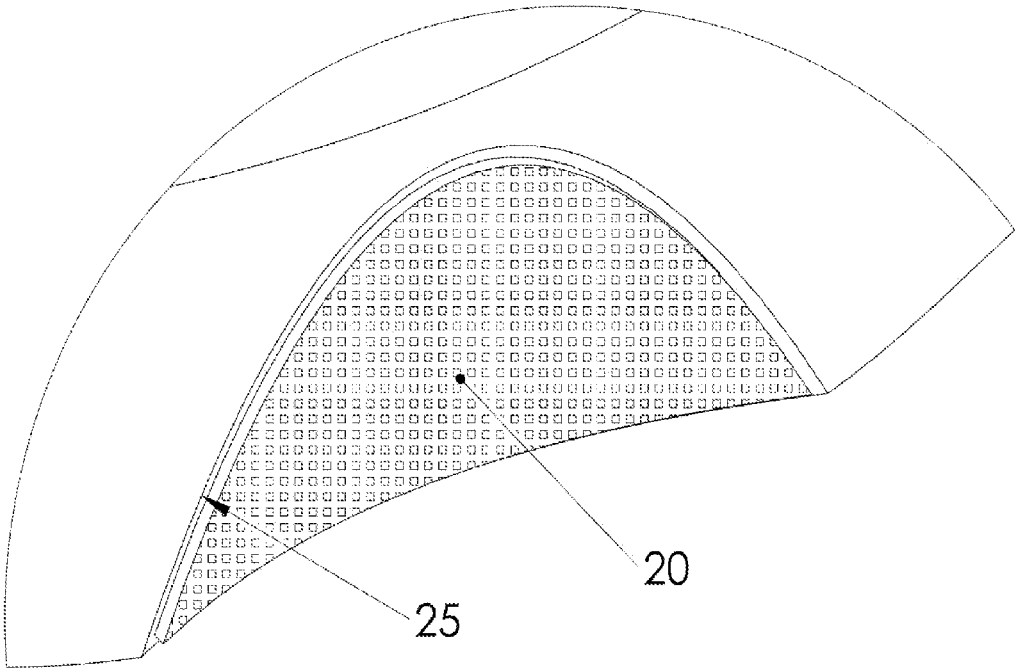
FIG. 9*a* is a detailed perspective view of the ergonomic guitar standard sound box rest pocket with an optional gripping pad.

It is intended that a variety of curved concave shapes are possible to create said standard rest pocket 25 such as parabolic or arcuate geometries. The top apex of the curve in the preferred embodiment is located below the front face of the sound box by approximately ¼ to ½ inch. Referring next to FIGS. 8 and 9, the standard position sound box pocket 25 is shown in the back and perspective views so that the concave curvature shape can be seen. This concave shape of the pocket provides a contoured fit on the upper thigh of the instrumentalist and keeps the guitar in a stable position without the need for wearing guitar straps. An alternative embodiment of the standard rest pocket 25 is shown in FIG. 9*a* where a thin gripping pad 20 is shown attached to said rest pocket 25. In the preferred embodiment, the gripping pad is made of a resilient material such as neoprene rubber and may have a textured surface as shown in order to increase the gripping power of the pad. Various means are possible to attach the gripping pad to the sound box rest pocket such as pressure sensitive adhesives. The thickness of the gripping pad in the preferred embodiment may be between 1/32 and 3/16 of an inch. The gripping pad 20 would be cut such that it fits inside the perimeter of the standard sound box rest pocket as shown in FIG. 9*a*.

Figure 10:
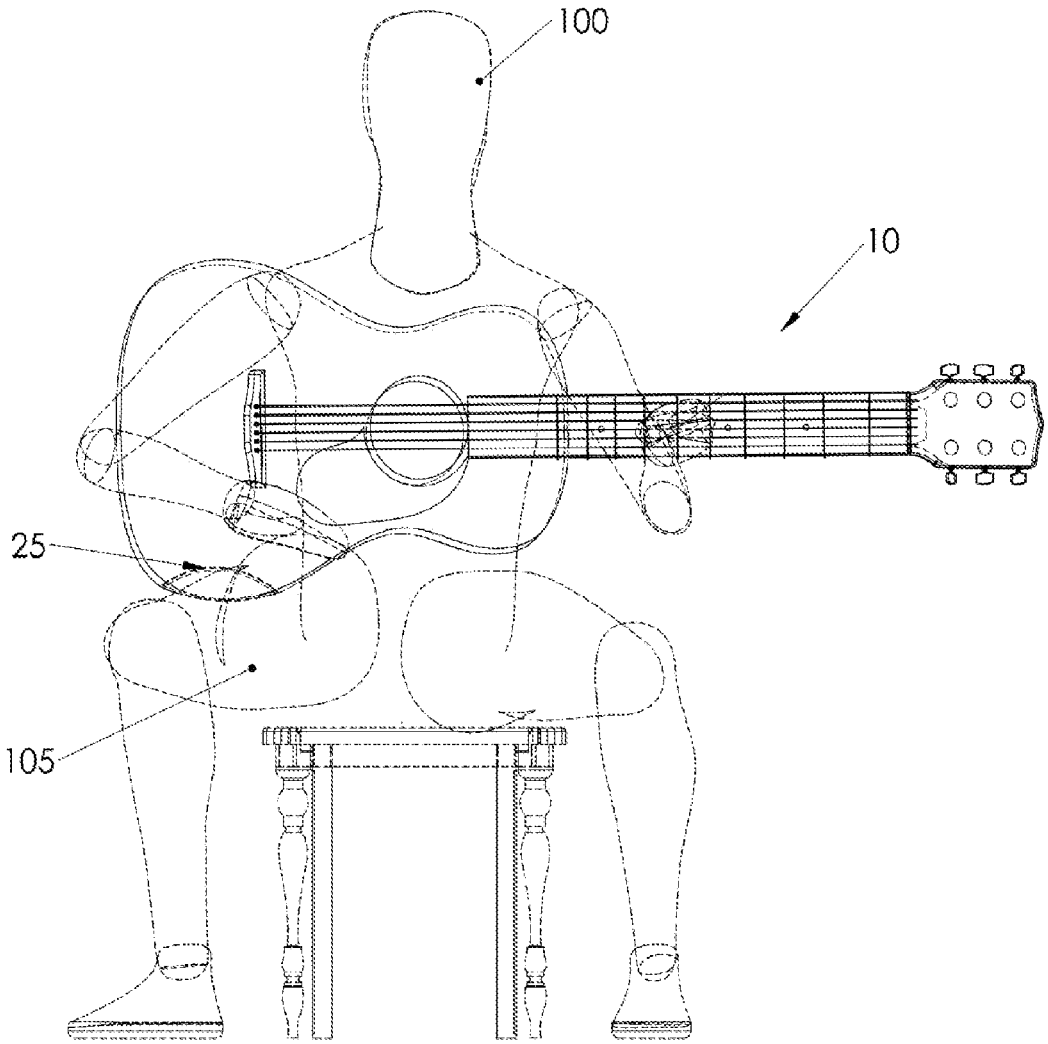
FIG. 10 is a view showing the use of the ergonomic guitar with a standard sound box rest pocket.

Referring now to FIG. 10, the intended use of the guitar with standard sound box rest pocket 25 is shown in the standard sitting position as represented by a right-handed instrumentalist 100. The concave shape of the rest pocket 25 fits over the upper right thigh 105 and creates a comfortable yet stable playing position. In the standard playing position, the orientation of the guitar is approximately parallel with the ground, and this is why the location of said standard sound box pocket 25 has shifted higher up on the guitar 10 as compared with the aforementioned classical playing position.

Figure 11:
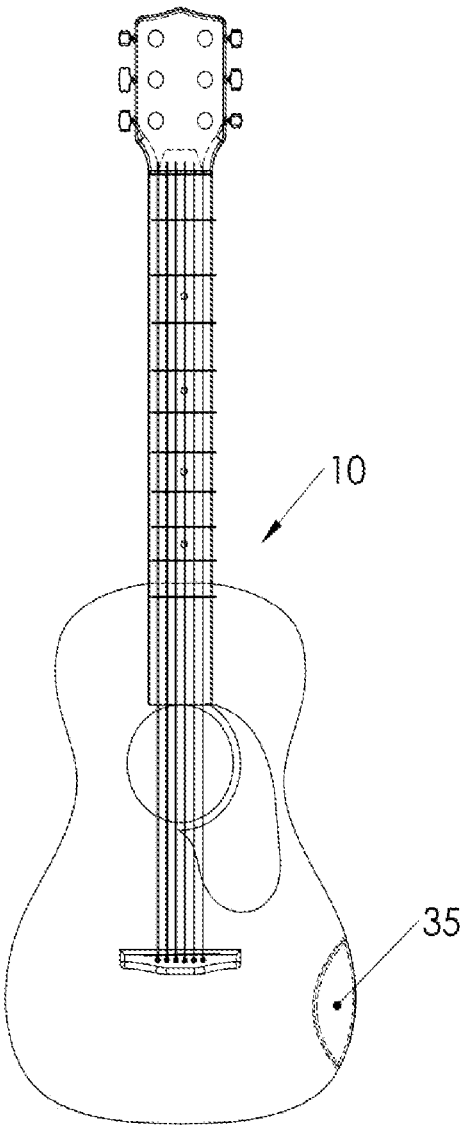
FIG. 11 is a front view of the ergonomic guitar showing a half standard sound box rest pocket that is located to provide better stability to the instrumentalist while playing in the standard sitting position.
Figure 12:
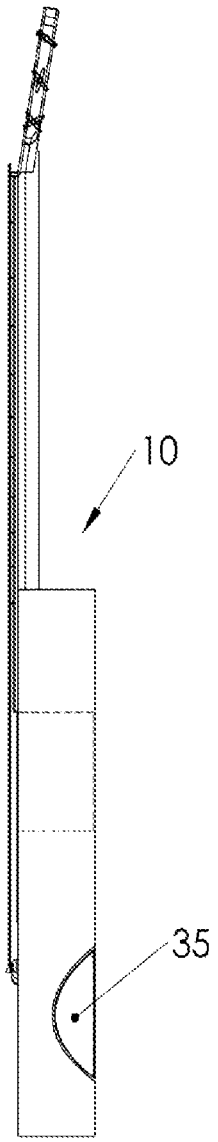
FIG. 12 is a side view of the ergonomic guitar with a half standard sound box rest pocket located to provide better stability to the instrumentalist while playing the standard sitting position.

Referring next to FIGS. 11 through 15, an acoustic guitar is again designated by reference number 10. In this third embodiment, a concave shaped pocket 35 is also provided for use in the standard sitting position and the location on the sound box is shown in FIG. 11. FIG. 12 shows the side view of the guitar 10 and in this view it can be seen that the apex of the pocket curvature starts at approximately half of the thickness of the guitar sound box. This allows the instrumentalist to not only further tilt the guitar sound box towards his chest while sitting in the standard position, but also allows the instrumentalist a greater degree of flexibility in playing positions by allowing movement of the guitar further forward on the thigh towards the knee without losing gripping surface.

Figure 13:
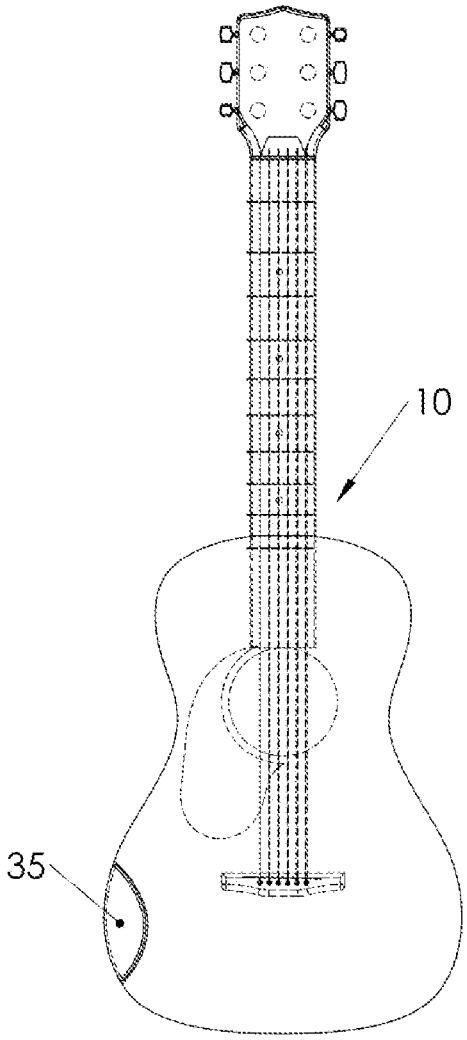
FIG. 13 is a back view of the ergonomic guitar with a half standard sound box rest pocket located to provide better stability to the instrumentalist while playing the standard sitting position.
Figure 14:
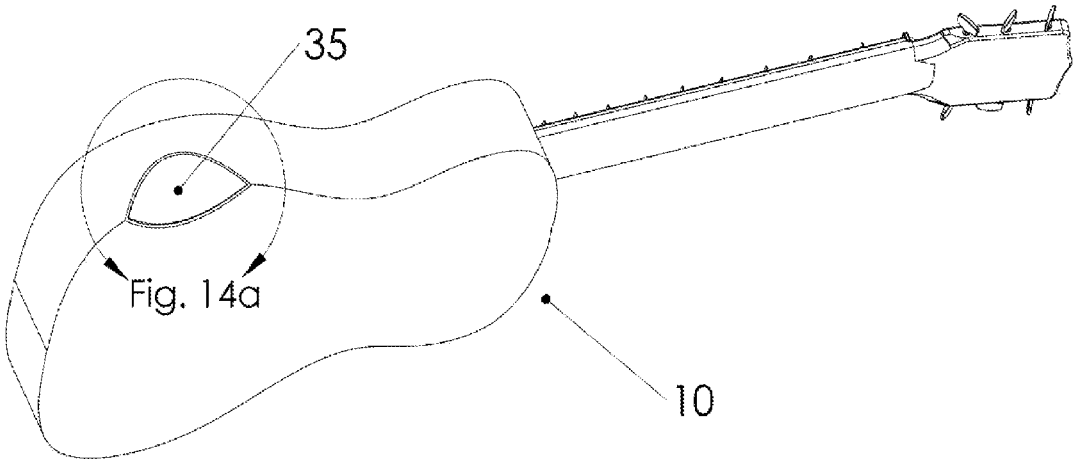
FIG. 14 is a perspective view of the ergonomic guitar with a half standard sound box rest pocket located to provide better stability to the instrumentalist while playing the standard sitting position.
Figure 14A:
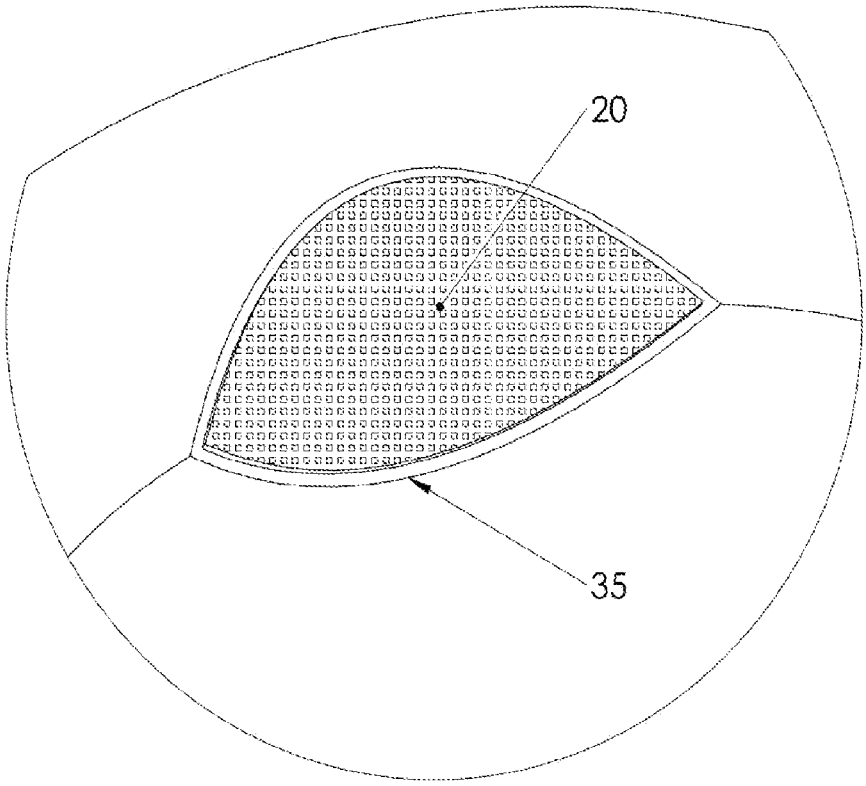
FIG. 14*a* is a detailed perspective view of the ergonomic guitar alternative half standard sound box rest pocket with an optional gripping pad.

It is intended that a variety of curved concave shapes are possible to create said standard rest pocket 35 such as parabolic or circular geometries. Referring next to FIGS. 13 and 14, the half standard position sound box pocket 35 is shown in the back and perspective views so that the concave curvature shape can be seen. This concave shape of the pocket provides a contoured fit on the curved upper thigh of the instrumentalist and keeps the guitar in a stable position without the need for wearing guitar straps. An alternative embodiment of the half standard rest pocket 35 is shown in FIG. 14*a* where a thin gripping pad 20 is shown attached to said half standard rest pocket 35. In the preferred embodiment, the gripping pad is made of a resilient material such as neoprene rubber and may have a textured surface as shown in order to increase the gripping power of the pad. Various means are possible to attach the gripping pad to the sound box rest pocket such as pressure sensitive adhesives. The thickness of the gripping pad in the preferred embodiment may be between 1/32 and 3/16 of an inch. The gripping pad 20 would be cut such that it fits inside the perimeter of the sound box rest pocket as shown in FIG. 14*a*.

Figure 15:
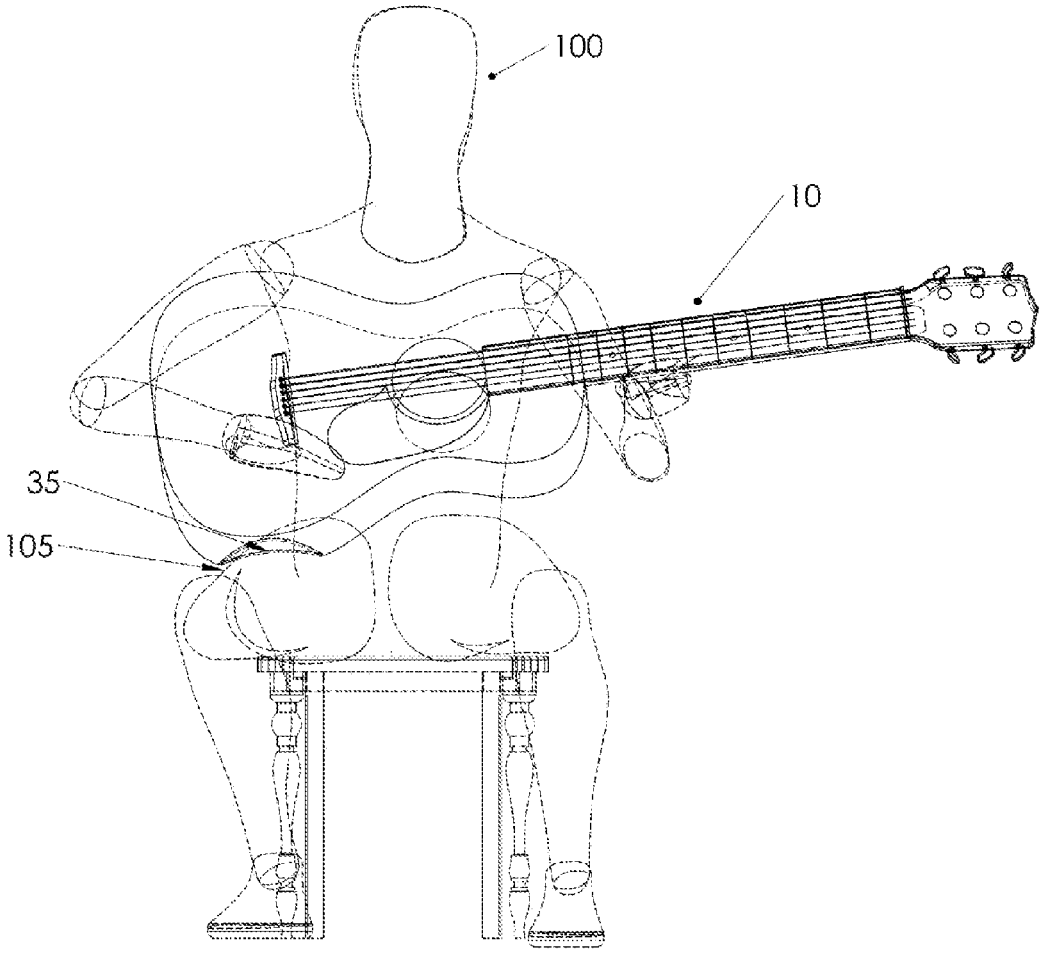
FIG. 15 is a view showing the use of the ergonomic guitar with a half standard sound box rest pocket.

Referring now to FIG. 15, the intended use of the guitar with the half standard sound box rest pocket 35 is shown in the standard sitting position as represented by a right-handed instrumentalist 100. The concave shape of the rest pocket 35 fits over the upper right thigh 105 and creates a comfortable yet stable playing position. It should be noted that in this embodiment, the orientation of the guitar 10 is still approximately parallel with the ground except the sound box of the guitar has been tilted slightly upwards towards the face of the instrumentalist. The movement of the apex of the curvature to start at approximately half of the distance of the sound box provides this additional degree of tilt while still creating a stable guitar playing position for the instrumentalist. Furthermore, the movement of the apex in the half standard rest pocket position provides a greater degree of flexibility in playing positions by allowing movement of the guitar further forward on the thigh towards the knee without losing gripping surface.

Figure 16A:
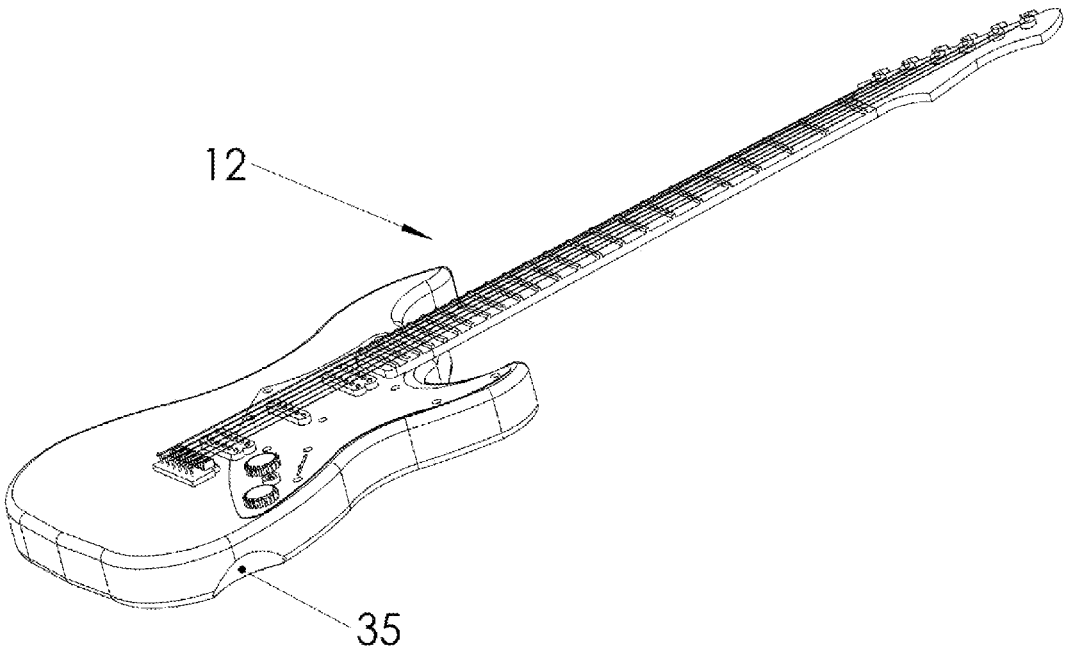
FIG. 16*a* is a perspective top view of an electric guitar with a half standard sound box rest pocket located for use in the standard sitting position.
Figure 16B:
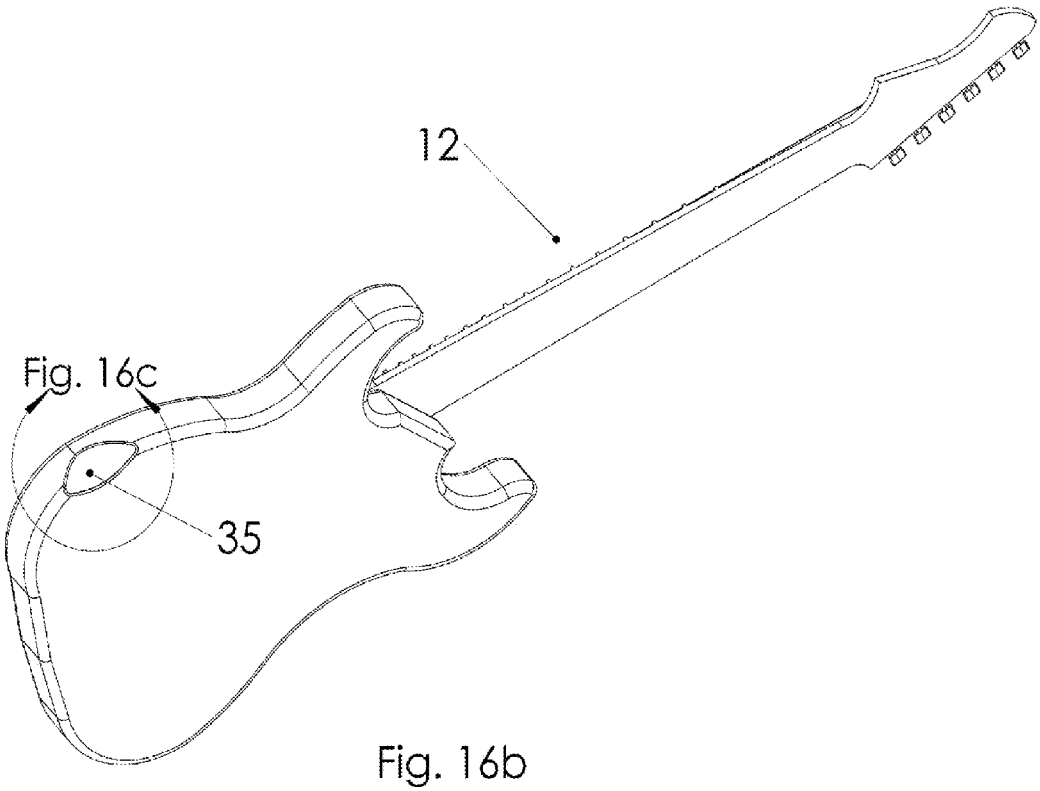
FIG. 16*b* is a perspective underside view of an electric guitar with a half standard sound box rest pocket located for use in the standard sitting position.
Figure 16C:
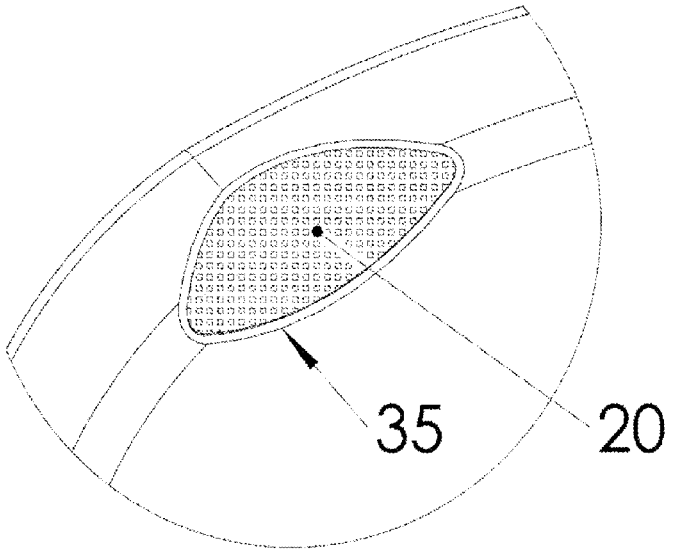
FIG. 16*c* is a detailed perspective view of the half standard position sound box rest pocket for an electric guitar with an optional gripping pad.

Although the embodiments of the present invention have thus far been shown only in acoustic guitar applications, the contoured rest pocket can be applied to other stringed instruments including electric guitars. FIGS. 16*a* and 16*b* show a fourth embodiment of the present invention where the sound box of an electric guitar 12 is modified to include a half standard sound box rest pocket 35. In yet another embodiment as shown in FIG. 16*c*, an optional gripping pad 20 is shown attached to the half standard sound box pocket 35 of said electric guitar 12.

Another advantage of the present invention is that the modifications to the sound box as discussed in these aforementioned embodiments do not have any adverse effects on the quality of the sound produced since the sound board itself is not compromised in any of the aforementioned sound box pocket embodiments. During future production of ergonomic guitars having any combination of stabilized sound box rest pockets 15, 25 or 35, the sound quality of the guitar can be measured using current sound measurement techniques as part of quality control release testing to verify that the ergonomic guitar meets quality control specifications based on the sound from a reference guitar without sound box rest pockets.

What is claimed is:

1. An ergonomic sound box of a stringed instrument comprising:

a sound board, a bottom, and a peripheral wall, characterized in that the peripheral wall includes a concave shaped pocket that is created from a parabolic or circular shaped arc that has an apex on the peripheral wall and whose endpoints lie on the bottom of the sound box;

wherein the position of the pocket is along the lower boute and adjacent the thigh when the instrument is played seated.

2. A sound box according to claim 1 that has the concave shaped pocket orientated at an angle between 120 and 170 degrees relative to the circular center of the sound board where 0 degrees lies on a line parallel to the strings.

3. A sound box according to claim 1 that has the apex of the concave shaped arc located between 1/4 inch from the sound board and one half of the overall thickness of the sound box.

4. A sound box according to claim 1 that has a concave curvature that extends into the bottom of the sound box between one inch and a maximum distance of four inches.

5. A sound box according to claim 1 that has a gripping pad attached by adhesive means to the inside perimeter of the concave shaped pocket that is made of a resilient material such as neoprene rubber and is between 1/32 inch and 3/16 inch in thickness.

6. A sound box according to claim 1 wherein the sound box is intended for use in acoustic guitars.

7. A sound box according to claim 1 wherein the sound box is intended for use in electric guitars.

* * * * *